US007462137B2

(12) United States Patent
Yang et al.

(10) Patent No.: US 7,462,137 B2
(45) Date of Patent: Dec. 9, 2008

(54) TWISTING DEVICE FOR CLIMBING EXERCISERS

(76) Inventors: Zhong-Jin Yang, 1F., No.5, Guoguang St., Taoyuan City, Taoyuan County 330 (TW); Hua-Lu Hsiang, No.323, Dasing Rd., Taoyuan City, Taoyuan County 330 (TW)

( * ) Notice: Subject to any disclaimer, the term of this patent is extended or adjusted under 35 U.S.C. 154(b) by 484 days.

(21) Appl. No.: 11/281,810

(22) Filed: Nov. 16, 2005

(65) Prior Publication Data

US 2007/0142182 A1 Jun. 21, 2007

(51) Int. Cl.
*A63B 22/04* (2006.01)

(52) U.S. Cl. ..... 482/53

(58) Field of Classification Search ..... 482/51–53, 482/57, 62, 114, 118
See application file for complete search history.

(56) References Cited

U.S. PATENT DOCUMENTS 4,555,109 A * 11/1985 Hartmann ..... 482/62
4,586,706 A * 5/1986 Chen ..... 482/62
5,545,111 A * 8/1996 Wang et al. ..... 482/53
5,749,809 A * 5/1998 Lin ..... 482/52
6,066,076 A * 5/2000 Wang et al. ..... 482/52
6,899,657 B2 * 5/2005 Chuang ..... 482/52
6,902,514 B2 * 6/2005 Chuang ..... 482/52
2002/0155926 A1 * 10/2002 Lat ..... 482/52

* cited by examiner

*Primary Examiner*—Steve R Crow
(74) *Attorney, Agent, or Firm*—Charles E. Baxley

(57) ABSTRACT

A twisting device for a climbing exerciser includes a rotatable member rotatably mounted on a cylindrical tube on the base and the rotatable member includes two flanges so that two connection plates connected with two pedals are respectively connected between the two flanges. The rotatable member is connected with a handlebar stem so that when the user operates the pedals alternatively, the two connection plates rotate the rotatable member reciprocally to drive the handlebar stem to twist about an axis of the handlebar stem.

6 Claims, 8 Drawing Sheets

TWISTING DEVICE FOR CLIMBING EXERCISERS

FIELD OF THE INVENTION

The present invention relates to a twisting device for a climbing exerciser and the twisting device operates smoothly while pivoting the two pedals alternatively.

BACKGROUND OF THE INVENTION

A conventional climbing exerciser with a twisting device is shown in FIGS. 7 and 8 and generally includes a base The present invention intends to provide an I-shaped base 7 and a post 72 extends from a center bar of the base 7. Two pedals are pivotably connected to two sides thereof and the two pedals 8 are connected with two respective cylinders so that they can be operated alternatively to overcome the resistance of the cylinders. A cylindrical tube is connected on the center bar and located bedside the post 72, a disk 71 is rotatably connected on the cylindrical tube and a handlebar stem 711 is fixed on the disk 71. A cable 9 has two ends thereof connected to the two pedals 8 respectively and the cable 9 reeves through the groove of the disk 71 so that when the two pedals 8 are pivoted alternatively, the cable 9 drives the disk 71 to rotate reciprocally. The user holds the handle on the handle stem 711 and twists with the rotation of the disk 71. However, the it is noted that the cable 9 will be broken after a period of time of use and once the cable 9 is broken, the twisting device is useless. Besides, the cable 9 might disengage from the groove of the disk 71 during operation, or the cable 9 can be loosened after a period of time of use.

SUMMARY OF THE INVENTION

The present invention relates to a climbing exerciser which comprises a base having a post and a cylindrical tube extending therefrom. A rotatable member is rotatably mounted to the cylindrical tube and a handlebar stem is fixed to the rotatable member. The rotatable member has two flanges with a gap defined therebetween. Two pedal assemblies are pivotably connected to two sides of the post and cooperated with two cylinders. Each pedal assembly has a pedal and a connection plate which is connected between the two flanges of the rotatable member. The handlebar stem is located between the two connection plates so that when the two pedal assemblies are alternatively operated, the two connection plates drive the rotatable member to let the handlebar stem twist.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
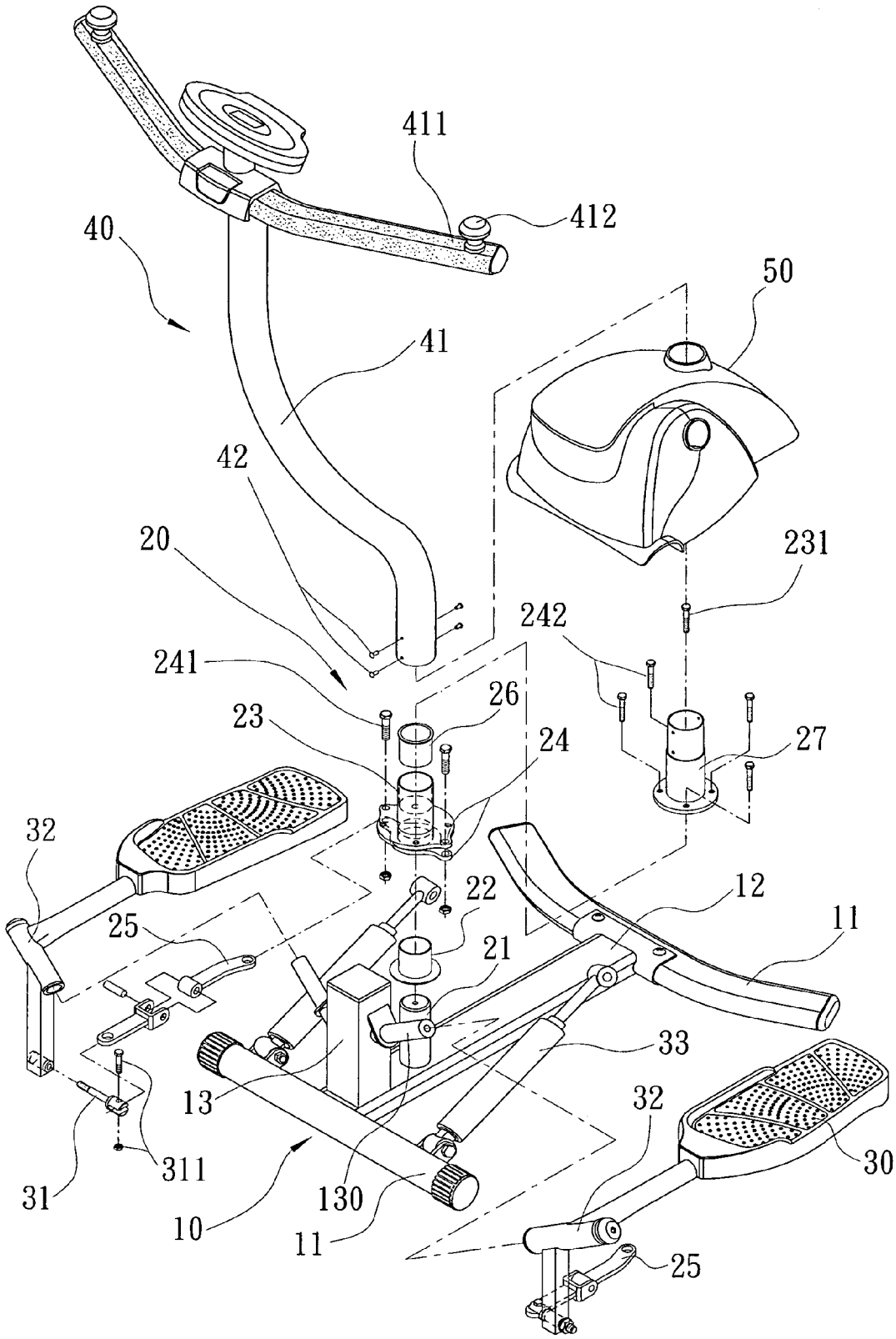
FIG. 1 is an exploded view to show the climbing exerciser of the present invention.
Figure 2:
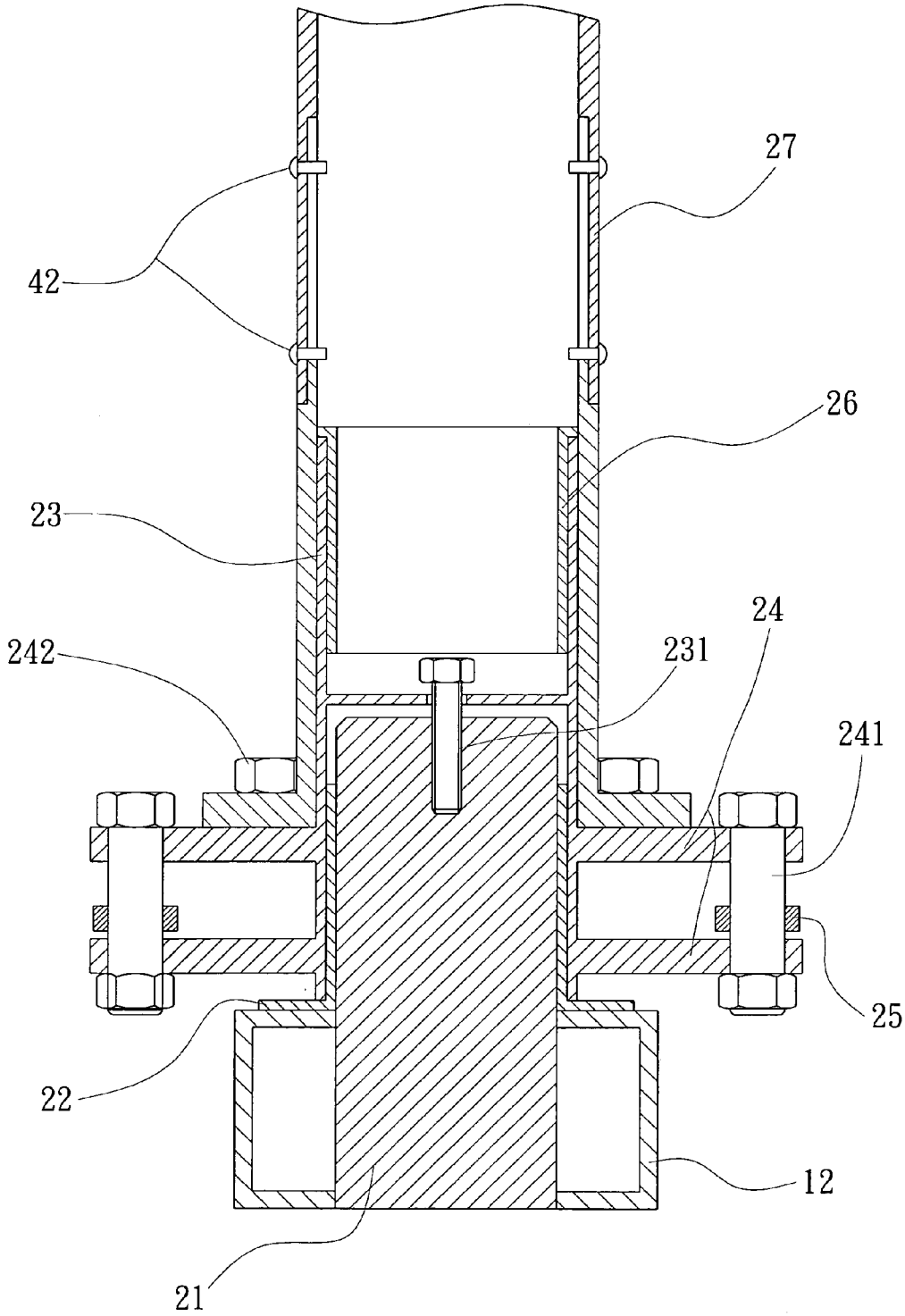
FIG. 2 is a cross sectional view of the twisting device of the present invention.
Figure 3:
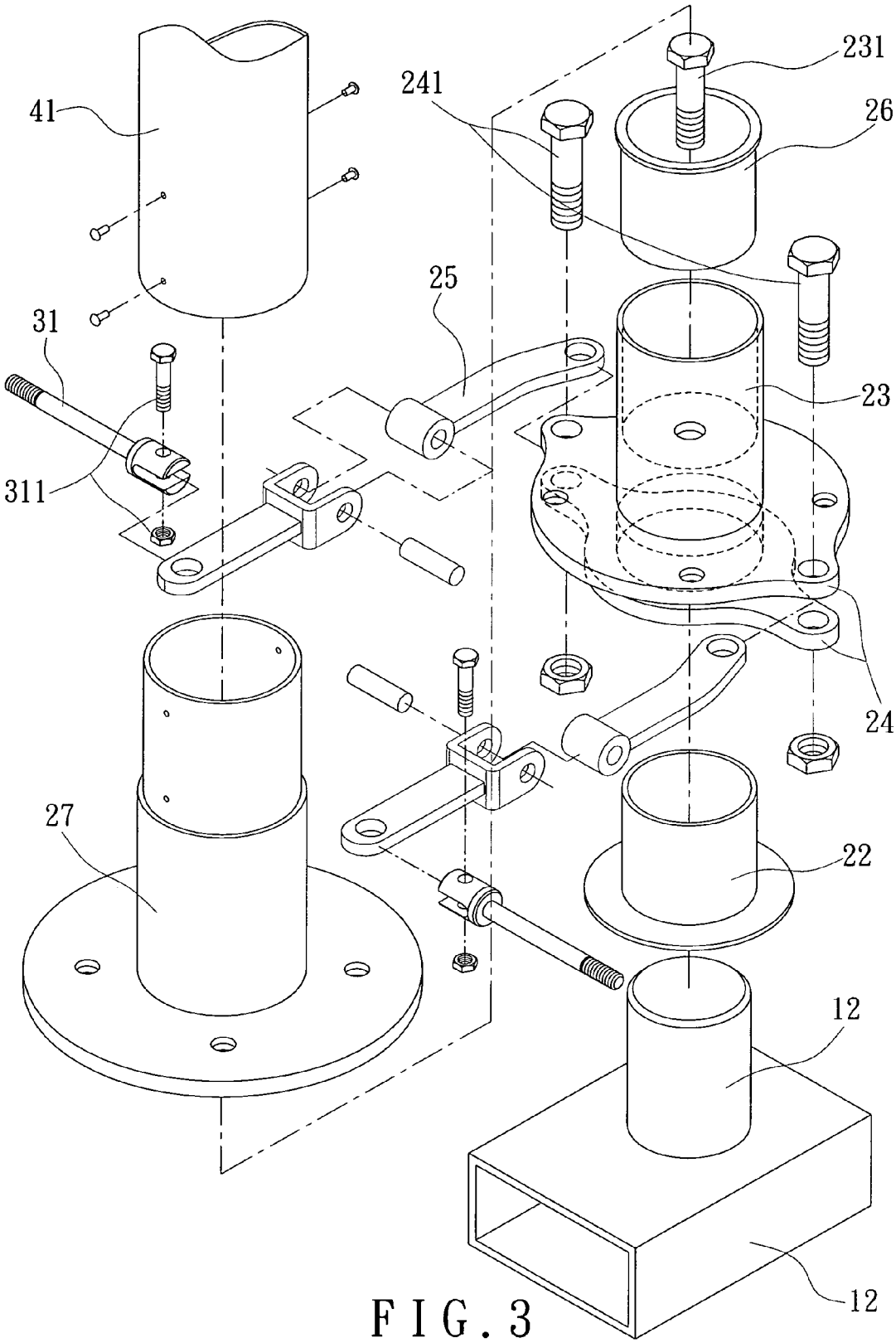
FIG. 3 is an exploded view to show the twisting device of the present invention.
Figure 4:
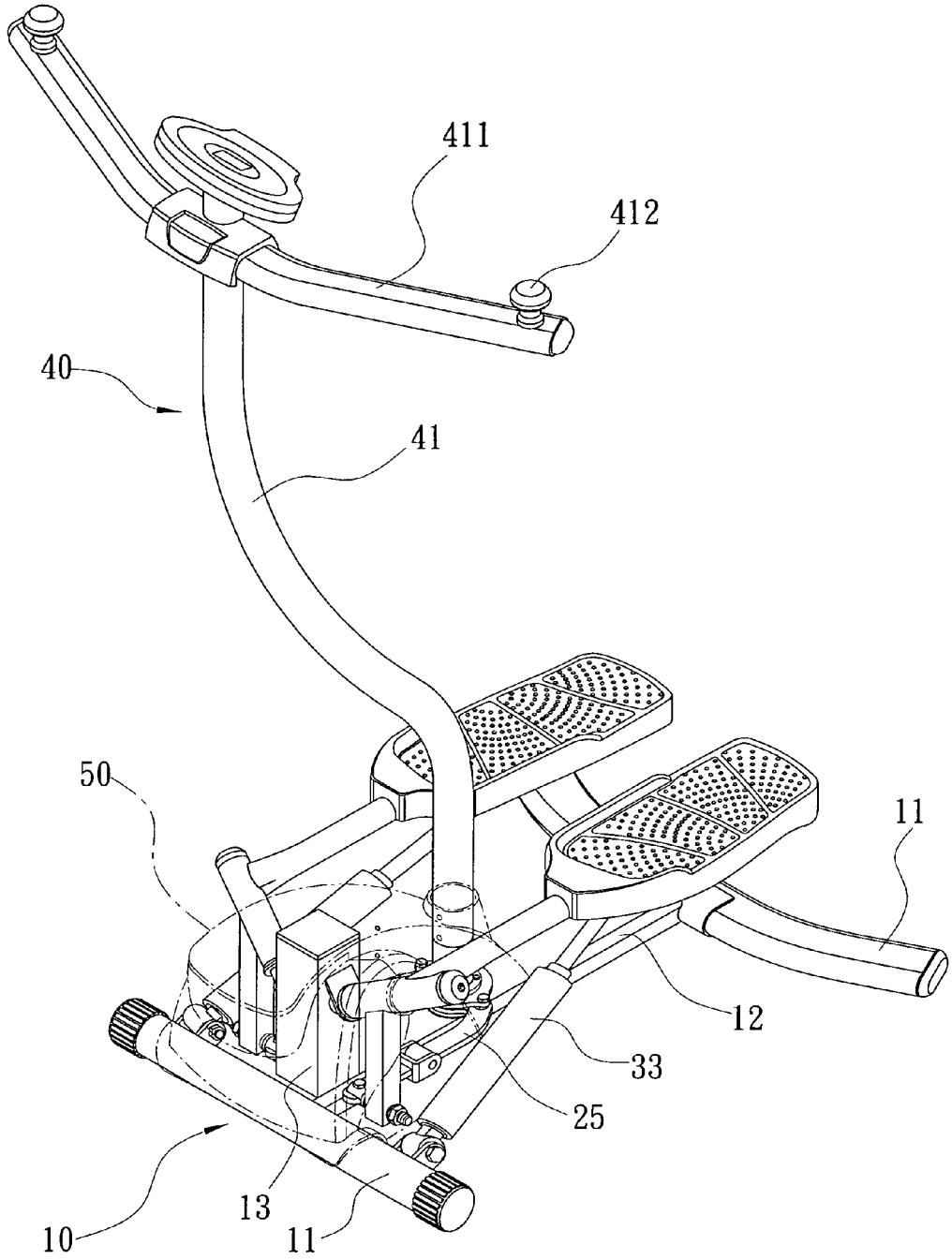
FIG. 4 is a perspective view to show the climbing exerciser of the present invention.

Referring to FIGS. 1 to 4, the climbing exerciser of the present invention comprises an I-shaped base 10 which includes a center bar 12 and two transverse bars 11 connected to two ends of the center bar 12. A post 13 and a cylindrical tube 21 extend from a top of the center bar 12, the cylindrical tube 21 is located beside the post 13. Two rods 130 extend from two opposite sides of the post 13 at an angle so as to be connected with two pedal assemblies. Two cylinders 33 each have a first end thereof pivotably connected to the base 10. A first sleeve 22 is mounted to the cylindrical tube 21.

A rotatable assembly 20 includes a rotatable member 23 which is rotatably mounted to the cylindrical tube 21 by a bolt 231 and a second sleeve 26 is received in a tubular portion of the rotatable member 23. The rotatable member 23 has two flanges 24 with a gap defined therebetween. A connection tube 27 is mounted onto the tubular portion of the rotatable member 23 and is fixed to one of the flanges 24 by two bolts 242.

A handlebar assembly 40 includes a handlebar stem 41 which is fixedly mounted to an outer periphery of the connection tube 27 and a plurality of positioning bolts 42 extend through the handlebar stem 41 and the connection tube 27 to position the handlebar stem 41 to the connection tube 27. A handlebar 411 is connected to the handlebar stem 41 and two protrusions 4112 are rotatably connected on a top of the handlebar 411.

The two pedal assemblies each include a mounting tube 32 which is rotatably mounted to the rod 130 corresponding thereto. A pedal 30 and an extension tube respectively extend from the mounting tube 32 in different directions. A connection bolt 31 is connected to a distal end of the extension tube and a first end of a connection plate 25 is fixed to the connection bolt 31 by a bolt and nut assembly 311. A second end of the connection plate 25 has a hole, and the two bolts 241 extend through the two flanges 24 and the two holes in the two respective connection plates 25. The handlebar stem 41 is located between the two connection plates 25. The two pedal assemblies respectively connected to two respective second ends of the two cylinders 33.

A case 50 is mounted onto the base 10 and hides the post 13 and the cylindrical tube 21 therein.

Figure 5:
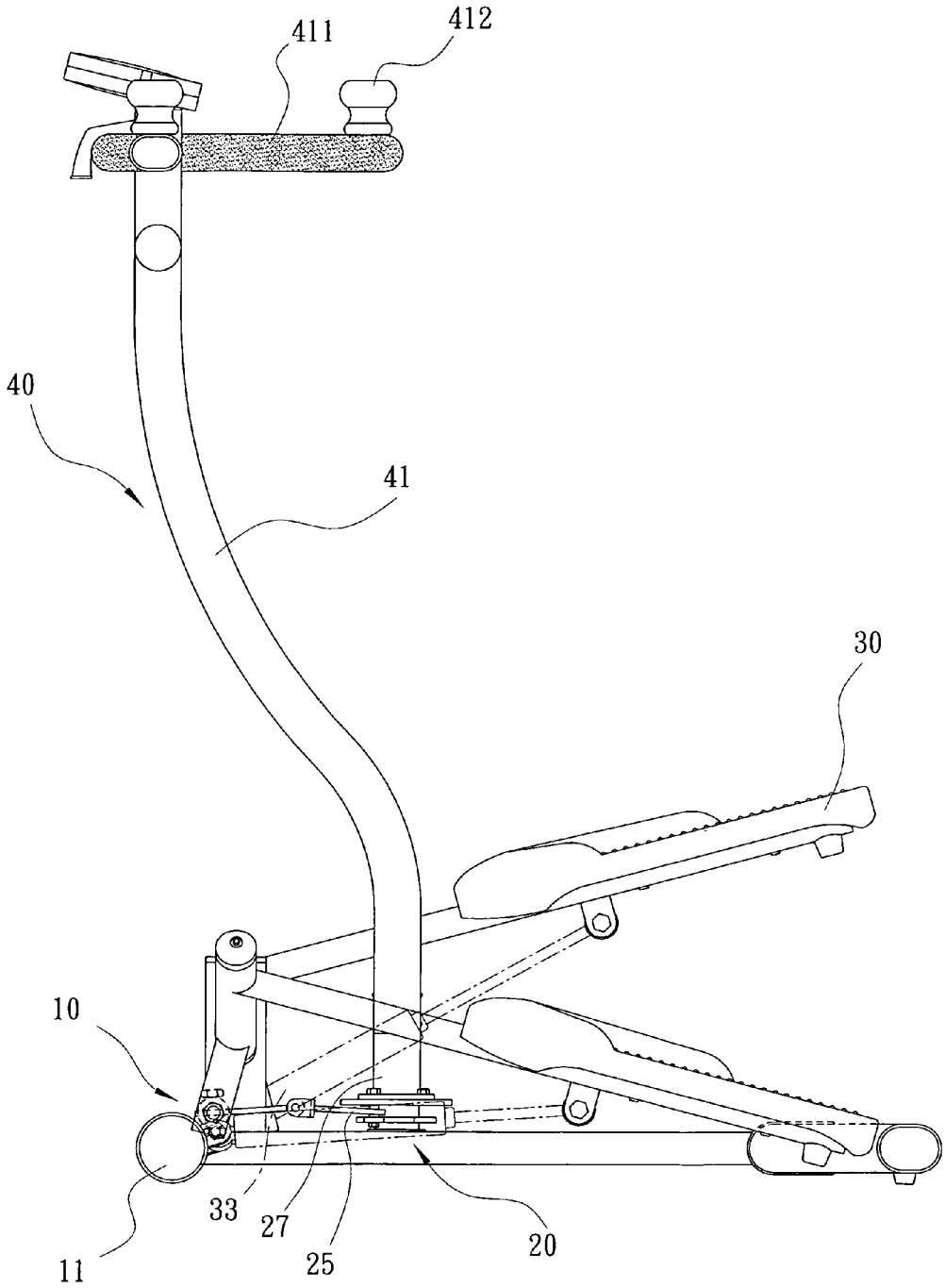
FIG. 5 is a side view to show the climbing exerciser of the present invention.
Figure 6:
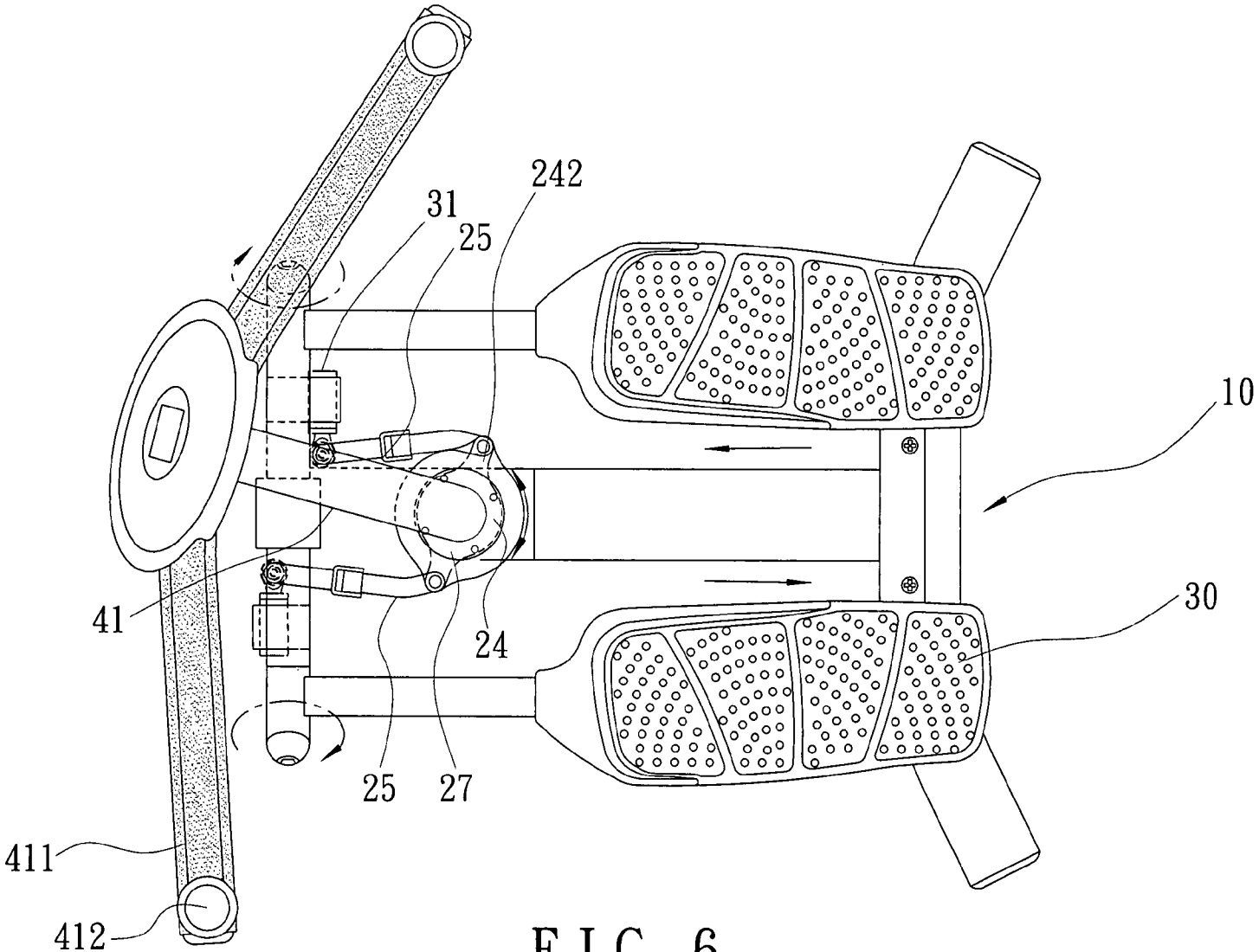
FIG. 6 is a top view to show the handlebar stem twists when the pedals are operated.
Figure 7:
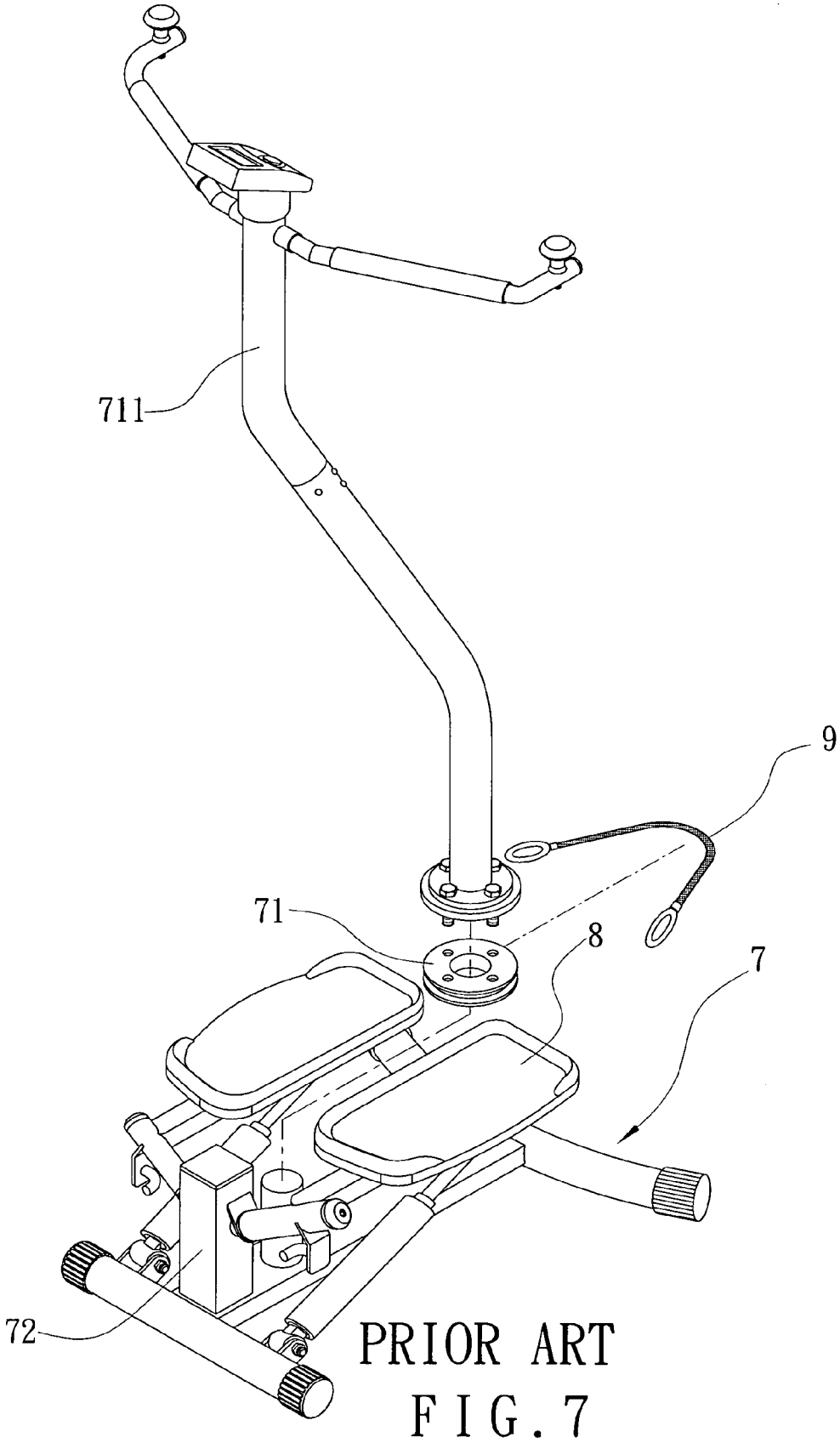
PRIOR ART FIG. 7
FIG. 7 is an exploded view to show a conventional climbing exerciser.
Figure 8:
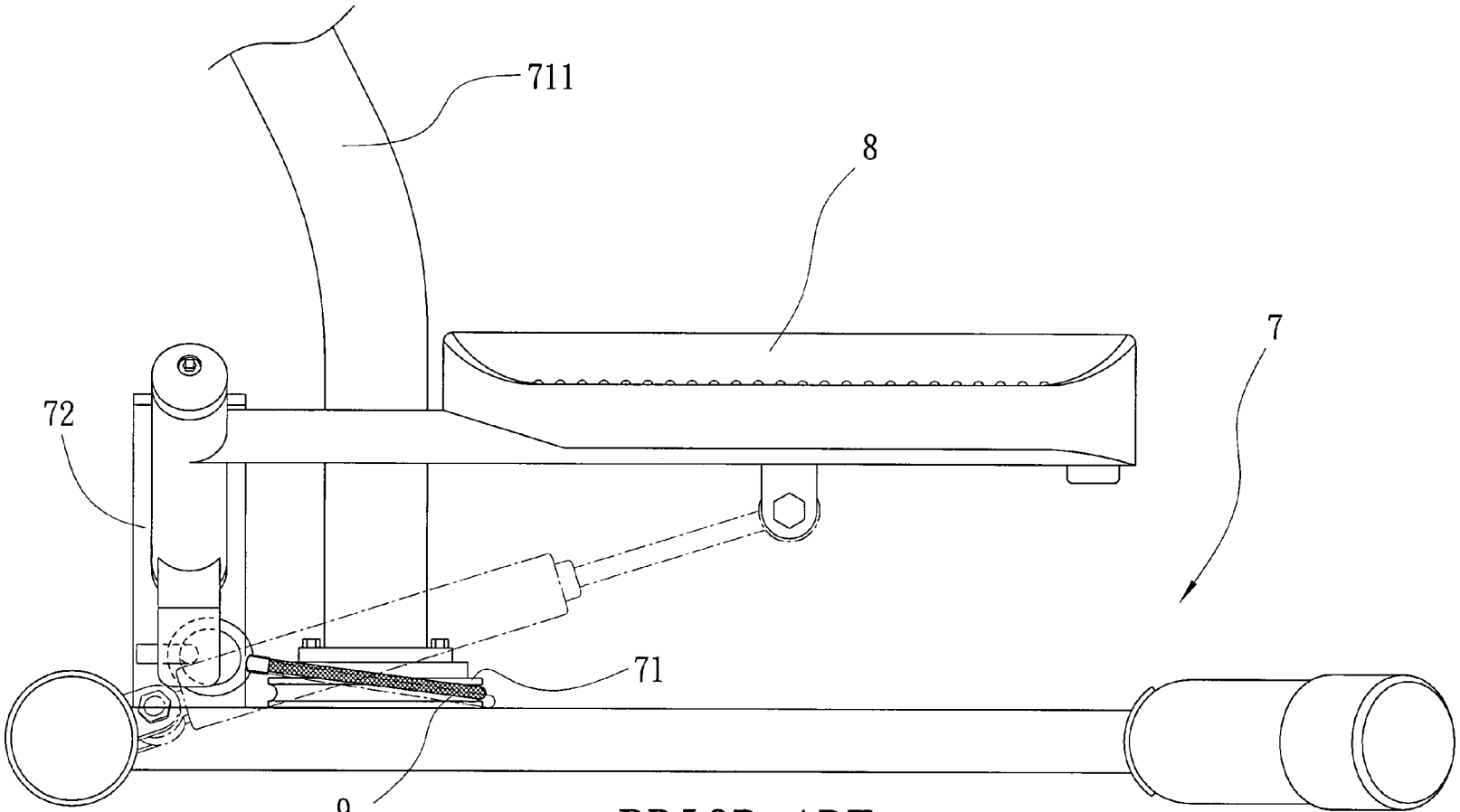
PRIOR ART FIG. 8
FIG. 8 is a side view to show the conventional climbing exerciser.

Referring to FIGS. 5 and 6, when the user pivoting the two pedals 30 alternatively, the movement of the pedals 30 pushes the two connection plates 25 which rotate the rotatable member 23. The connection tube 27 is fixed to the rotatable member 23 so that the handlebar stem 41 is rotated with the connection tube 27. By this way, the user twists his or her body when operating the climbing exerciser. Because the connection tube 27 is driven by two connection plates 25 which are solid and strong parts so that the twisting movement of the connection tube 27 is precise and smooth.

While we have shown and described the embodiment in accordance with the present invention, it should be clear to those skilled in the art that further embodiments may be made without departing from the scope of the present invention.

What is claimed is:

1. A climbing exerciser comprising:

a base having a post extending therefrom and a cylindrical tube located beside the post, two cylinders each having a first end thereof pivotably connected to the base;

a rotatable member rotatably mounted to the cylindrical tube and a handlebar stem fixed to the rotatable member, the rotatable member having two flanges with a gap defined therebetween;

two pedal assemblies pivotably connected to two sides of the post and each pedal assembly having a pedal and a connection plate which is connected between the two flanges of the rotatable member; the handlebar stem located between the two connection plates, the two pedal assemblies respectively connected to two respective second ends of the two cylinders; wherein two rods extend from two opposite sides of the post at an angle and each pedal assembly includes a mounting tube which is rotatably mounted to the rod corresponding thereto; the pedal and an extension tube respectively extend from the mounting tube; a connection bolt is connected to a distal end of the extension tube; and a first end of each of the connection plates is fixed to a connection bolt which is connected to said post, and a second end of each connection plate has a hole; and two bolts extend through the two flanges and the respective holes in the two respective connection plates.

2. The exerciser as claimed in claim 1, wherein a first sleeve is mounted to the cylindrical tube and the rotatable member is rotatably mounted onto the cylindrical tube, a second sleeve received in a tubular portion of the rotatable member, a connection tube is mounted onto the tubular portion of the rotatable member and is fixed to one of the flanges; the handlebar stem is fixedly mounted to an outer periphery of the connection tube.

3. The exerciser as claimed in claim 2, wherein a plurality of positioning bolts extend through the handlebar stem and the connection tube to position the handlebar stem to the connection tube.

4. The exerciser as claimed in claim 1, wherein the base includes a center bar and two transverse bars are connected to two ends of the center bar; the post and the cylindrical tube extend from a top of the center bar.

5. The exerciser as claimed in claim 1, wherein a handlebar is connected to the handlebar stem and two protrusions are rotatably connected on a top of the handlebar.

6. The exerciser as claimed in claim 1, wherein a case is mounted onto the base and hide the post to the cylindrical tube therein.

* * * * *